US006825613B2

(12) United States Patent
Chow et al.

(10) Patent No.: US 6,825,613 B2
(45) Date of Patent: Nov. 30, 2004

(54) MERCURY GAS DISCHARGE DEVICE

(75) Inventors: Shing Cheung Chow, New Territories (HK); Lap Lee Chow, New Territories (HK)

(73) Assignee: Colour Star Limited (HK)

( * ) Notice: Subject to any disclaimer, the term of this patent is extended or adjusted under 35 U.S.C. 154(b) by 0 days.

(21) Appl. No.: 10/242,504

(22) Filed: Sep. 12, 2002

(65) Prior Publication Data

US 2004/0051453 A1 Mar. 18, 2004

(51) Int. Cl.[7] ..... H01J 17/24
(52) U.S. Cl. ..... 313/558; 313/490
(58) Field of Search ..... 313/490, 633, 313/635, 640, 558

(56) References Cited

U.S. PATENT DOCUMENTS

| | | | | |
|---|---|---|---|---|
| 3,758,184 A | 9/1973 | Menzel | 316/25 | |
| 5,214,351 A | 5/1993 | Nieda | 313/619 | |
| 6,110,807 A | 8/2000 | Conte et al. | | |
| 6,322,720 B1 | 11/2001 | Reutova et al. | | |

FOREIGN PATENT DOCUMENTS

| | | | |
|---|---|---|---|
| JP | 52-55856 | 5/1977 | H01J/7/18 |
| JP | 5546417 | 4/1980 | |
| JP | 06-338288 | 12/1994 | H01J/61/26 |
| JP | 07-057696 | 3/1995 | H01J/61/24 |
| JP | 07-235282 | 9/1995 | H01J/61/24 |
| JP | 963459 | 3/1997 | |
| JP | 1204048 | 7/1999 | |
| JP | 11224647 | 8/1999 | |
| JP | 200030660 | 1/2000 | |
| JP | 2001167686 | 6/2001 | |
| JP | 2002-124213 | 4/2002 | H01J/61/26 |
| KR | 2001039379 | 5/2001 | |

*Primary Examiner*—Vip Patel
(74) *Attorney, Agent, or Firm*—Ostrolenk, Faber, Gerb & Soffen, LLP

(57) ABSTRACT

A mercury gas discharge device comprises an envelope with inert gas and mercury vapour contained within it. The mercury gas discharge device further comprises a pair of electrodes. One or more sintered metal portions are also located inside the envelope. The sintered metal portions have high gettering characteristics with respect to waste gases, but low gettering characteristics with respect to the mercury vapour.

20 Claims, 3 Drawing Sheets

MERCURY GAS DISCHARGE DEVICE

FIELD OF THE INVENTION

This invention relates to mercury gas discharge devices, in particular mercury vapour fluorescent lamps including hot cathode and cold cathode fluorescent lamps (CCFLs).

BACKGROUND OF THE INVENTION

Nowadays, cold cathode fluorescent lamps (CCFLs) are often used as miniature high luminous intensity light sources. They feature simple construction, are miniature in size, have high luminous intensity, exhibit small increases in lamp temperature during operation, and have a relatively long operating life. Because of these characteristics, CCFLs have been widely used as a light source in various backlit light units and scanners.

In recent years, rapid developments in information technology. communication equipment and office and consumer products have necessitated development of CCFLs with better performance, increased functionality and smaller size. Meanwhile, LCD backlit sources have been developed with the aim of increasing the area of coverage, reducing power consumption and extending operational lifetime. Currently, CCFLs are mass produced and have great difficulty meeting these ever increasing demands, An example of a current CCFL is shown in FIG. 1. FIG. 1 shows a glass envelope 2 with a fluorescent powder film 4 coated onto its interior wall. Gas 5 such as a neon and argon mixture with a source of mercury vapour are confined in glass envelope 2. Electrodes 1 are disposed at opposing ends of glass envelope 2.

Electrodes 1 are a key component of the CCFL. They are responsible for conducting electricity, emitting electrons, forming a magnetic field, and for other lamp and heating functions. To a large extent, lamp performance depends upon the choice of the electrode material.

Electrodes commonly used in CCFLs include an electrode wire 6 formed of tungsten, dumet or kovar and a cathode in the form of a nickel tube or nickel bucket 3 welded onto the part of electrode wire 6 which is inside glass envelope 2. Conventional nickel tubes or nickel buckets are made using high-ratio compression.

In conventional CCFL construction, the operating surface area of the nickel tube or nickel bucket 3 is limited by the inner diameter of glass envelope 2 and the length of the electrode. Accordingly, any increase in the lamp's luminous intensity during operation is limited by the surface area of the nickel tube or nickel bucket and the melting point of nickel which is approximately 1453° C. As a result of these limitations, current CCFL's are not able to withstand a large lamp electric current and the impact of a strung electron stream. The limited surface area of the nickel tube or nickel bucket also limits the amount of active alkaline metals such as barium, calcium, strontium and cesium that can be added. These metals can be added to the cathode to enhance electron emission efficiency.

During long term operation, the glass and fluorescent powder used in fluorescent lamps or current CCFLs continually discharge and deposit waste materials inside the glass tube. Waste gases, such as water, oxygen, nitrogen, carbon monoxide and carbon dioxide, develop and proliferate from the materials used. These waste gases enter into the interior of the lamp. They result in an increase in resistance to electrical conductivity within the lamp, and cause damage to the cathode by reacting with the active alkaline metals that can be added to the cathode. This reduces the functioning of the lamp and is known to present difficulties when attempting to produce high quality, small sized, high luminous intensity and high performance fluorescent lamps and CCFLs.

The aforementioned problems do not only exist in CCFLs, but are also found in any other mercury gas discharge device, including but not limited to mercury vapour sunlamp and germ-killing ultraviolet light tube utilizing mercury vapour.

SUMMARY OF THE INVENTION

It is an object of the present invention to provide a mercury gas discharge device such as a cold cathode fluorescent lamp (CCFL) with a construction that overcomes or at least ameliorates the problems of prior art. mercury gas discharge devices. Another object of the invention is to provide a mercury gas discharge device such as a CCFL that operates under a larger operating electric current without affecting the device's operational lifetime. It is a further object of the present invention to provide a mercury gas discharge device such as a CCFL that provides greater intensity and longer operational lifetime when compared with current mercury gas discharge devices. These and further objects and advantages of the present invention will be discussed in more detail throughout the description of the invention.

A mercury gas discharge device constructed according to an embodiment of the present invention comprises an envelope with inert gas and mercury vapour confined within the envelope. The envelope also includes a pair of electrodes. One or more sintered metal portions are also located in the envelope. The sintered metal portions have high gettering characteristics with respect to waste gases, but low gettering characteristics with respect to the mercury vapour.

DETAILED DESCRIPTION OF PREFERRED EMBODIMENTS

Figure 2:
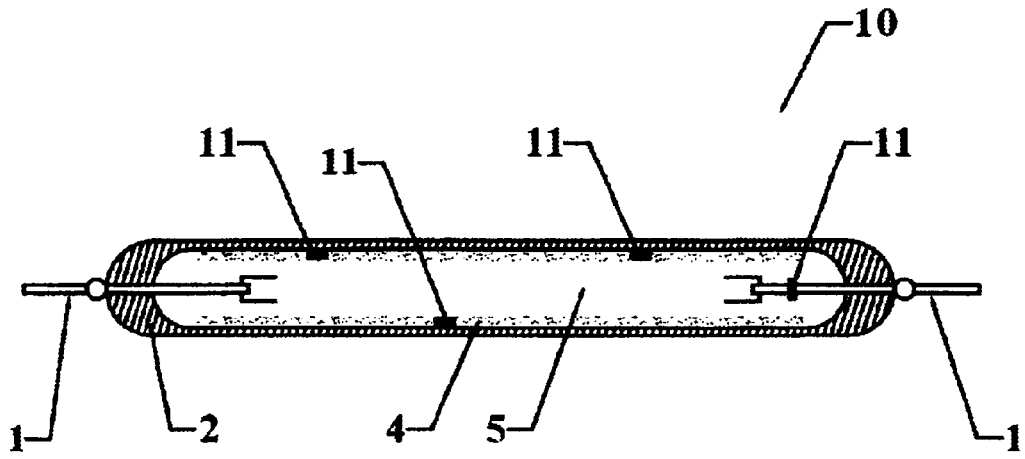
FIG. 2 is a schematic diagram illustrating a CCFL constructed in accordance with an embodiment of the present invention.

Referring firstly to FIG. 2, there is provided a fluorescent lamp 10 comprising a tube 2 with an interior wall and an exterior wall and a fluorescent powder film coating 4 on the interior wall. Inert gas and mercury vapour 5 are confined within the tube and the lamp includes a pair of electrodes 1. One or more sintered metal portions 11 are also located in tube 2. Sintered metal portions 11 have high gettering characteristics with respect to waste gases such as water, oxygen, nitrogen, carbon monoxide and carbon dioxide, but low gettering characteristics with respect to the mercury vapour.

One or more sintered metal portions 11 may be placed anywhere within tube 2. It is preferred that sintered metal portions 11 are welded in the tube, preferably welded to one or more of electrodes 1, although welding to electrodes is not essential. In an embodiment where one or more sintered metal portions 11 are welded to an electrode, they may be welded to any part of the electrode which is inside tube 2.

There may be any number of sintered metal portions 11 within tube 2. The number of sintered metal portions 11 included is preferably determined by the size of tube 2. When tube 2 is small, only one sintered metal portion 11 may be required to achieve the advantages of the invention.

Figure 4:
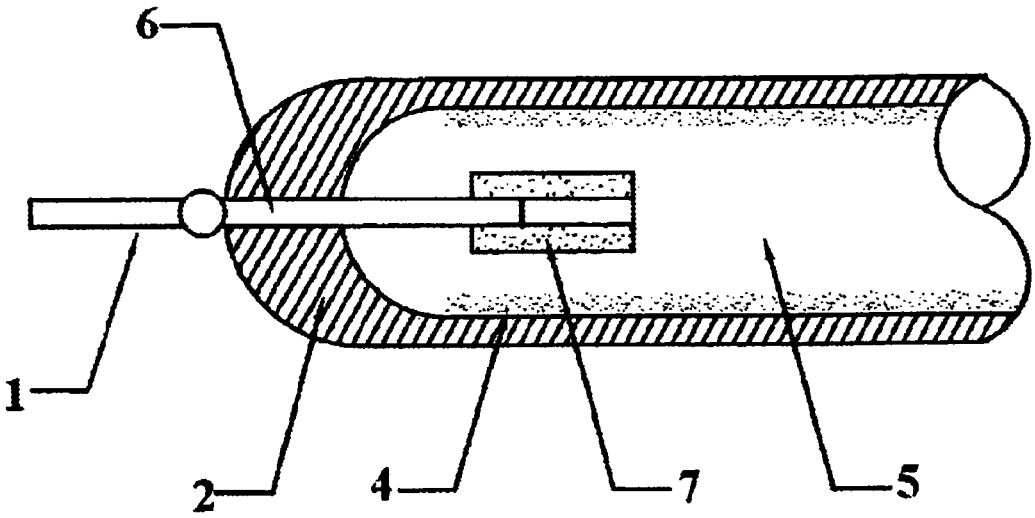
FIG. 4 is a schematic diagram illustrating a CCFL constructed in accordance with another embodiment of the present invention.
Figure 5:
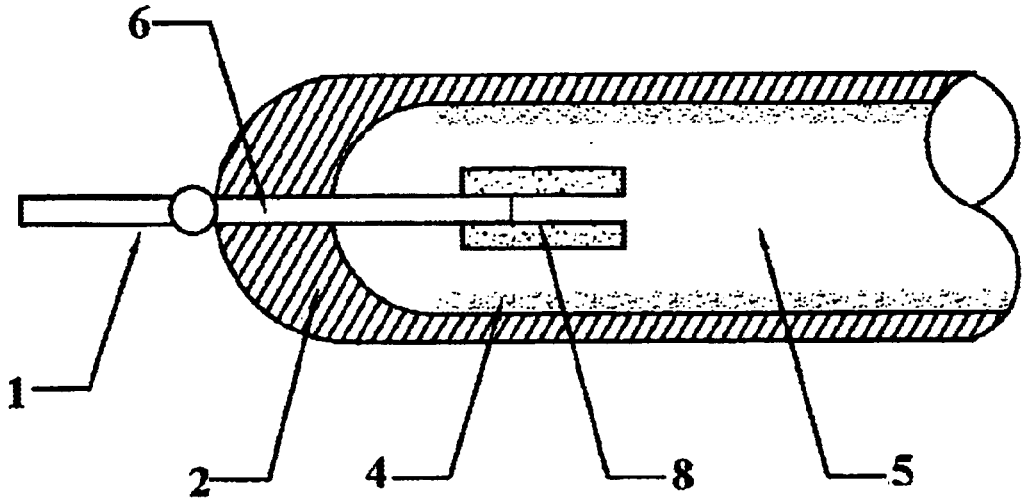
FIG. 5 is a schematic diagram illustrating a CCFL constructed in accordance with a further embodiment of the present invention.

Now referring to FIGS. 4 and 5, schematic diagrams are shown which illustrate two particular embodiments of the invention. In these embodiments, tube 2 may be any appropriate type of tube and is preferably a glass tube. It is preferred that the sintered metal portion is a sintered metal tube (or bucket) 7 or plate 8 (which can be in a pair as shown in FIG. 5) which is welded on to the part of each electrode wire 6 which extends inside the tube. The sintered metal tube (or bucket) 7 or plate 8 may be manufactured using typical metal powder metallurgy techniques or ultrasonic moulding press or any other appropriate methodology.

During the sintering process, very small particles of the chemical element are strongly bonded together under high temperature without melting the elements. Bonding without melting results in a large number of internal pores within the sintered article. These pores increase the physical gettering characteristics of the metal portion by enhancing its porosity, and, when the sintered portion is used as a cathode, increase the surface area for electron emission and for adding active alkaline metals (such as barium, calcium, strontium and cesium) for enhancing electron emission efficiency.

The sintered metal tube 7 or plate 8 (which may also be provided in the form of a bucket, not shown) preferably includes at least one metal element which is selected from a first group of metal elements which have high gettering characteristics with respect to waste gases and low gettering characteristics with respect to the mercury vapour within tube 2. Preferably such metal elements have very low gettering characteristics with respect to mercury vapour. Accordingly the first group of metal elements includes but is not limited to ferrous family metals such as iron, nickel and cobalt. These metal elements react chemically with waste gases such as water, oxygen, nitrogen, carbon monoxide and carbon dioxide under operating temperatures of the lamp 10 but not with the mercury vapour. Therefore, the gettering characteristics of the sintered metal tube 7 or plate 8 is enhanced by the inclusion of one or more of the metal elements included in the first group.

When the lamp 10 operates, high temperatures are generated inside tube 2, particularly in the vicinity of electrode wires 6 (and sintered metal tube 7 or plate 8 when used as a cathode or when welded to an electrode). As these high temperatures develop, it is possible for sintered metal tube 7 or plate 8 to break or sputter. Accordingly, it is preferred that sintered metal tube 7 or plate 8 is a combination of metal elements which also includes one or more metals from a second group that exhibit high temperature resistance in combination with low or very low gettering characteristics with respect to the mercury vapour, thereby reducing the possibility of sputtering. Metals such as molybdenum and tungsten are appropriate for inclusion in the second group of metals.

In a preferred embodiment, sintered metal tube 7 or plate 8 is a metallic combination comprising between 2 and 5 metal elements with at least one of the metal elements being selected from the first group (high gettering characteristics with respect to waste gases but not mercury vapour) and at least one of the metal elements being selected from the second group (resistant to high temperatures with low or very low gettering characteristics with respect to mercury vapour). It is preferred that the sintered metallic combination is porous with a porosity of 50% to 4% and a relative density of 50% to 96%.

In another embodiment, where the sintered metal portion is used as a cathode, the metal portion further includes one or more active alkaline metals for enhancing the efficiency with which electrons are emitted from the cathode. The active alkaline metals may include but are not limited to barium, calcium, strontium, and cesium.

Figure 3:
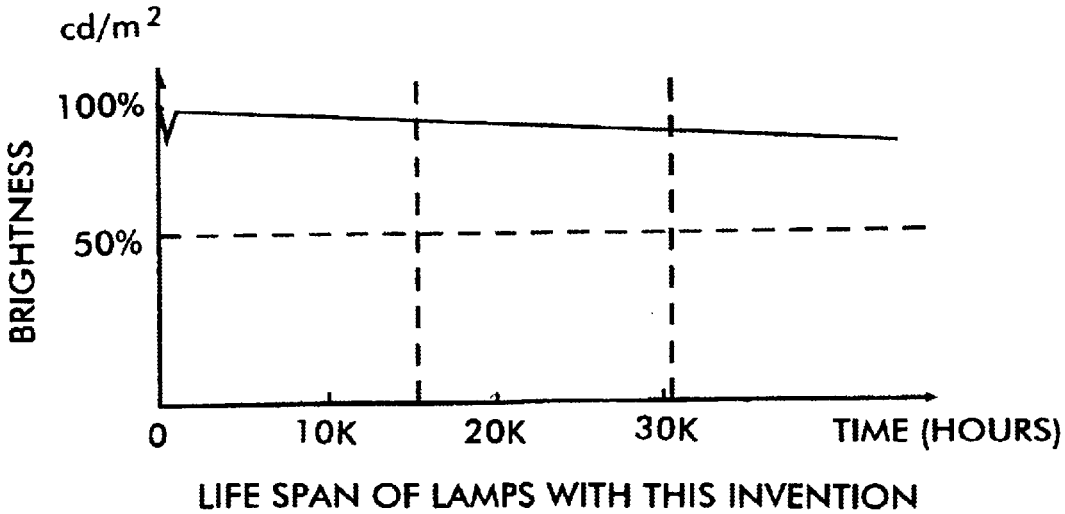
FIG. 3 is a graph showing the typical life span of a CCFL constructed in accordance with an embodiment of the present invention.

Referring to FIG. 3, a graph shows brightness or luminous intensity versus life span for a CCFL constructed with a sintered porous metal tube or plate according to the present invention. In the primary stage of operation (i.e. during approximately the first 200 hours of operation), the graph of FIG. 3 shows a distinct drop in luminous intensity of around 3 to 5%. This is due to the proliferation of waste gases derived from the glass, fluorescent powder and the electrodes. The proliferation of these waste gases results in contamination and sputtering inside the lamp. Meanwhile, during operation the sintered porous metal tube or plate continues to attempt to increase absorption of the waste gases.

After around 400 hours of operation, the proliferation of waste gases stabilizes and the sintered metal tube or plate begins to function as a gettering device, absorbing large quantities of the waste gases. As the waste gas content in the glass tube decreases, the luminous intensity of the lamp increases, and the CCFL regains its former luminosity as evidenced by the rapid increase in luminous intensity in FIG. 3. This advantage can not be achieved by conventional mercury vapour fluorescent lamps.

During aging, luminosity drops due to the generation of the waste gases. Mercury vapour is also slowly and gradually absorbed by the fluorescent powder contributing further to the drop in luminosity, but such drop is of a lesser extent because the chemical affinity between fluorescent powder and mercury vapour is weak. FIG. 3 shows a gradual linear decline in luminosity or brightness which corresponds to this aging process. However, the decrease in luminous intensity is slower and steadier than that of conventional CCFLs. Since the decrease occurs over a longer time, the aging period of the lamp of the present invention is much longer than that of conventional lamps. After approximately 15000 hours of operation, the fall in luminous intensity of a fluorescent lamp constructed according to the present invention is around 10% less than the fall in brightness which occurs in conventional fluorescent lamps after the same lifetime. This is achieved in part by the continuous gettering function provided by the sintered metal portion which maintains a very low level of waste gases in the glass tube during lamp operation.

This is complemented by the fact that the sintered metal selected does not react with or absorb mercury vapour during operation. As a result, the content of the mercury vapour within the tube is maintained at a higher level for longer, thereby reducing the rate at which the lamp's luminous intensity decreases when compared with conventional lamps.

According to the luminous intensity vs lifespan graph of FIG. 3, it is anticipated that the fluorescent lamp of the present invention is capable of withstanding twice the operational electric current of conventional fluorescent lamps. For example, the operational electric current of a conventional CCFL with an outer diameter of 2.6 mm is 5 mA. However, a CCFL constructed in accordance with the present invention with the same outer diameter and with a sintered porous metallic combination tube can withstand an operational electric current of up to 10 mA, achieving an increased luminous intensity of 8,000 to 10,000 cd/m$^2$ whilst maintaining comparable lamp life (approximately 15,000 to 20,000 hours). Further, if the CCFL of the present invention and the conventional CCFL operate using the same current, the operational life of the inventive CCFL may exceed 50,000 hours. This is an improvement of 100 to 150% when compared with conventional CCFLs.

Figure 1:
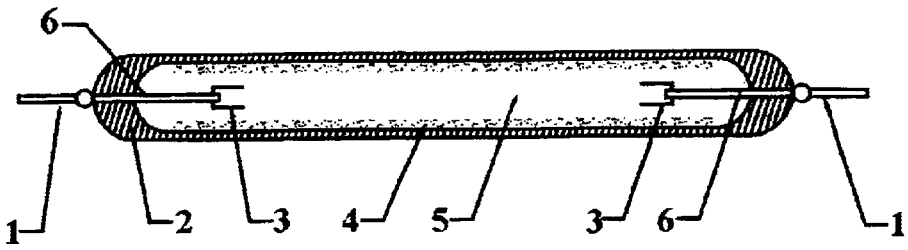
FIG. 1 PRIOR ART
FIG. 1 is a schematic diagram illustrating the construction of known CCFLs.

FIG. 4 shows a schematic illustration of a CCFL constructed according to an embodiment of the present invention. It comprises glass envelope 2, fluorescent powder film 4 coated onto the interior wall of glass envelope 2 and inert gas and mercury vapour 5 confined inside glass envelope 2, Electrodes 1 are located at the ends of the lamp (only one shown). Electrodes 1 include electrode wire 6 sealed at the end of envelope 2 and extending from the interior to the exterior of envelope 2. In contrast to the CCFL of FIG. 1, the inventive CCFL has a sintered metal tube 7 composed of a combination of 2 to 5 metal elements welded onto electrode wires 6 and used as a cathode, although sintered metal tube 7 may be welded anywhere in glass envelope 2. This replaces the conventional nickel tube 3 illustrated in FIG. 1.

The inventive sintered metal tube 7 is produced by metallic powder processes using typical powder metallurgy and is, therefore, a porous product. As a result, its surface area is 2 to 20 times greater than that of the high density compacted nickel tube of conventional lamps. The sintered metal tube 7 can therefore absorb or accommodate more of active alkaline metals such as barium, calcium, strontium and cesium etc. which act as activating elements for electron emission, thereby reducing the resistance to electron emission at cathode.

The inventive sintered metal portion composition is preferably chosen from the following group of compositions:

| | | | | | |
|---|---|---|---|---|---|
| 1. | tungsten or molybdenum OR tungsten + molybdenum | 70% to 90% | TO | 10% to 30% | iron or nickel or cobalt OR iron + nickel + cobalt OR iron + nickel OR iron + cobalt OR nickel + cobalt |
| 2. | tungsten or molybdenum OR tungsten + molybdenum | 40% to 70% | TO | 30% to 60% | iron or nickel or cobalt OR iron + nickel OR iron + cobalt OR nickel + cobalt OR iron + nickel + cobalt |
| 3. | tungsten or molybdenum OR tungsten + molybdenum | 10% to 40% | TO | 60% to 90% | iron or nickel or cobalt OR iron + nickel OR iron + cobalt OR nickel + cobalt OR iron + nickel + cobalt |

It is not Glossary for the inventive sintered metal portion to be composed only of elements in the aforementioned first and second groups of metal elements. However, it is preferred that the proportion of metal elements selected from the first group in combination with the proportion of metal elements selected from the second group comprises between 50% and 100% of the total sintered metal composition.

Case Study 1

A linear CCFL is produced with an outer diameter of 2.6 mm, an inner diameter of 2.0 mm, a lamp length of 243 mm and uses a sintered porous metal tube composed of tungsten, molybdenum, iron and cobalt and welded onto a tungsten electrode. The composition is, tungsten+molybdenum: 10 to 40% iron+cobalt 90 to 60%

The electrode tube is sealed in a borosilicate (hard glass) tube, the interior wall of which is coated with fluorescent powder film with a color temperature of 5800° K. The borosilicate tube is filled with an appropriate neon/argon gas combination and a mercury vapour source, and is ignited with circuitry known in the art. In operation at 7.5 mA and 15 mA, the CCFL of Case Study 1 has performance characteristics as shown in Table 1 below.

TABLE 1

| Operating Current | 7.5 mA | 15 mA | Performance Change |
|---|---|---|---|
| Luminous Intensity | 44000 cd/m$^2$ | 55000 cd/m$^2$ | +25% |
| Luminous Flux | 176 lumen | 212 lumen | 0.205 |
| After intensive aging test, equivalent to 4,000 hours of normal operation: | | | |
| Luminous Intensity | 42030 cd/m$^2$ | 52030 cd/m$^2$ | +23.8% |
| Luminous Flux | 151 lumen | 189 lumen | +25% |
| Decrease in Luminous Intensity | 4.5% | 5.4% | |
| | Conventional average drop is 8.5–10% | | |

Extrapolating the data obtained from Case Study 1, it is estimated that a CCFL constructed using the described porous sintered metal combination will achieve a lamp life of 25.000 to 30,000 hours of continuous operation at 7.5 mA. and a lamp life of 10,000 to 15,000 hours of continuous operation at 15 mA This performance exceeds the capabilities of conventional CCFLs.

Case Study 2

A linear cold cathode fluorescent lamp (CCFL) is produced with an outer diameter of 1.8 mm, an inner diameter of 1.2 mm and lamp length of 72.5 mm as illustrated in FIG. 5. The feature distinguishing the CCFL of FIG. 5 from that of FIG. 4 is the use of porous sintered metal plate 8 in place of tube 7. The sintered porous metal plate is composed of tungsten, molybdenum, iron, nickel and cobalt and is welded onto a tungsten electrode. The composition is:

tungsten+molybdenum: 10 to 40% iron+nickel+cobalt: 90 to 60%

The electrode plate is sealed in a borosilicate (hard glass) tube, the interior wall of which is coated with fluorescent powder film with a color temperature of 6500° K. The borosilicate tube is filled with an appropriate neon/argon gas combination and a mercury vapour source, and is ignited with circuitry, as known in the art. In operation at 2 mA and 3 mA, the CCFL of Case Study 2 has performance characteristics as shown in Table 2 below.

TABLE 2

| Operating Current | 2 mA | 3 mA | Performance Change |
|---|---|---|---|
| Luminous Intensity | 28930 cd/m$^2$ | 40070 cd/m$^2$ | +38.5% |
| After intensive aging test, equivalent to 6,250 hours of normal operation: | | | |
| Luminous Intensity | 26520 cd/m$^2$ | 34150 cd/m$^2$ | +28.7% |
| Decrease in Luminous Intensity | 8.3% | 14.8% | — |

It is to be noted that conventional lamps are not capable of operating for extended periods at an operational current of 2 mA.

Case Study 3

A linear cold cathode fluorescent lamp (CCFL) is produced with an outer diameter of 2.6 mm, an inner diameter of 2.0 mm and a lamp length of 243 mm. It uses a sintered porous metal tube composed of tungsten, molybdenum, iron and cobalt and welded onto a tungsten electrode. The composition is:

tungsten+molybdenum: 70 to 90% iron+cobalt: 30 to 10%

The electrode tube is sealed in a borosilicate (hard glass) tube, the interior wall of which is coated with fluorescent powder film with a color temperature of 5800° K. The borosilicate tube is filled with an appropriate neon/argon gas combination and a mercury vapour source, and is ignited with circuitry, as known in the art. In operation at 7.5 mA, the CCFL of Case Study 3 has performance characteristics as shown in Table 3 below.

TABLE 3

| | |
|---|---|
| Operating Current | 7.5 mA |
| Luminous Intensity | 44000 cd/m$^2$ |
| After intensive aging test, equivalent to 15,000 hours of normal operation: | |
| Luminous Intensity | 39020 cd/m$^2$ |
| Decrease in Luminous Intensity | 11.3% (conventional average drop: [[9]] 29%) |

Extrapolating the data obtained from Case Study 3, it is estimated that a CCFL constructed using the described porous sintered metal tube will achieve a life of approximately 40,000 hours of continuous operation.

The mercury gas discharge device (such as a CCFL) constructed according to the present invention uses sintered metal portions (such as tubes, buckets or plates) to improve gettering within the device envelope, thus increasing intensity, extending lifetime of the device and significantly improving performance. In one embodiment the inventive sintered metal portion is porous. Therefore, it has an increased operational surface area when compared with the getters of conventional mercury gas discharge devices or CCFLs. Accordingly, the device is able to withstand higher operating currents whilst maintaining steady operating conditions and intensity; when the operating current increases, so too does the intensity or luminous intensity. In particular, a CCFL with a porous sintered portion, when used as the cathode and constructed according to an embodiment of the present invention, exhibits a significantly higher luminous intensity index than conventional fluorescent lamps.

It is to be noted that a mercury gas discharge device (such as a CCFL) constructed according to the present invention would also exhibit an increase in temperature during operation. The increase in temperature will release any mercury vapour which has become physically trapped within the sintered metal portion, but will not release waste gases as they will be chemically bound to the "gettering" metal.

A sintered metal portion according to an embodiment of the present invention forms compounds with waste gases in the device envelope and absorbs them. These sintered metal portions become more active when protected in a vacuum or inert gas environment. Accordingly, they exhibit a stronger binding force to waste gases such as oxygen, nitrogen, carbon monoxide and carbon dioxide as well as water, thereby providing significantly improved gettering characteristics as well as serving as "conventional" cathode when welded to the end of an electrode inside the device envelope.

The inventive sintered metal portion is ideal for use in multi functional, high efficiency and long life CCFLs. A CCFL according to the present invention exhibits a life span which is among the longest of all CCFLs.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A mercury gas discharge device comprising:

(a) a closed envelope;

(b) inert gas and mercury vapor confined within the envelope;

(c) a pair of electrodes communicating from outside to inside the envelope and being spaced apart inside the envelope; and (d) one or more sintered metal portions located inside the envelope;

wherein the sintered metal portions have higher gettering characteristics with respect to waste gases, but lower gettering characteristics with respect to the mercury vapor.

2. A mercury gas discharge device according to claim 1 wherein the one or more sintered metal portions include iron, nickel and/or cobalt.

3. A mercury gas discharge device according to claim 1 wherein the one or more sintered metal portions comprise a combination of:

(a) one or more first metallic elements having higher gettering characteristics with respect to waste gasses but lower gettering characteristics with respect to the mercury vapor; and (b) one or more second metallic elements being resistant to high temperatures within the mercury gas discharge device and having lower gettering characteristics with respect to the mercury vapor.

4. A mercury gas discharge device according to claim 3 wherein the proportion of first metallic elements in combination with the proportion of second metallic elements comprises between 50% and 100% of a total sintered metal composition of the sintered metal portions.

5. A mercury gas discharge device according to claim 3, wherein the first metallic elements are selected from the group consisting of iron, nickel and cobalt, and the second metallic elements are selected from the group consisting of molybdenum and tungsten.

6. A mercury gas discharge device according to claim 1 wherein at least one of the sintered metal portions is used as a cathode of the mercury gas discharge device.

7. A mercury gas discharge device according to claim 6 wherein one or more of the sintered metal portions further includes one or more active alkaline metals for enhancing the efficiency with which electrons are emitted from the cathode.

8. A mercury gas discharge device according to claim 7, wherein the active alkaline metals comprising but not limited to one or more of the following:

(a) barium;

(b) calcium;

(000c) strontium; and (000d) cesium.

9. A mercury gas discharge device according to claim 1 wherein one or more of the sintered metal portions is a porous sintered metal.

10. A mercury gas discharge device according to claim 9 wherein the porous sintered metal has a porosity of 50% to 4% and a relative density of 50% to 96%.

11. A fluorescent lamp comprising:

(a) an enclosed tube with an interior wall and an exterior wall and a fluorescent powder film coating on the interior wall;

(b) inert gas and mercury vapour confined within the tube;

(c) a pair of electrodes communicating from outside to inside the envelope and being spaced apart inside the envelope; and (d) one or more sintered metal portions located inside the tube;

wherein the sintered metal portions have higher gettering characteristics with respect to waste gases, but lower gettering characteristics with respect to the mercury vapor.

12. A fluorescent lamp according to claim 11 wherein the one or more sintered metal portions include iron, nickel and/or cobalt.

13. A fluorescent lamp according to claim 11 wherein the one or more sintered metal portions comprise a combination of:

(a) one or more first metallic elements selected from a first group having higher gettering characteristics with respect to waste gasses but lower gettering characteristics with respect to the mercury vapor; and (b) one or more second metallic elements being resistant to high temperatures within the fluorescent tube and having lower gettering characteristics with respect to the mercury vapor.

14. A fluorescent lamp according to claim 13 wherein the proportion of first metallic elements in combination with the proportion of second metallic elements comprises between 50% and 100% of the total sintered metal composition of the sintered metal portion.

15. A fluorescent lamp according to claim 13, wherein the first metallic elements are selected from the group consisting of iron, nickel and cobalt, and the second metallic elements are selected from the group consisting of molybdenum and tungsten.

16. A fluorescent lamp according to claim 11 wherein at least one of the sintered metal portions is used as a cathode of the lamp.

17. A fluorescent lamp according to claim 16 wherein one or more of the sintered metal portions further includes one or more active alkaline metals, for enhancing the efficiency with which electrons are emitted from the cathode.

18. A fluorescent lamp according to claim 17, wherein the active alkaline metals comprising but not limited to one or more of the following:

(a) barium;

(b) calcium;

(000c) strontium; and (000d) cesium.

19. A fluorescent lamp according to claim 11 wherein one or more of the sintered metal portions is a porous sintered metal.

20. A fluorescent lamp according to claim 19 wherein the porous sintered metal has a porosity of 50% to 4% and a relative density of 50% to 96%.

* * * * *